United States Patent [19]

Lounis

[11] Patent Number: 4,862,699

[45] Date of Patent: Sep. 5, 1989

[54] METHOD AND APPARATUS FOR RECOVERING, PURIFYING AND SEPARATING REFRIGERANT FROM ITS LUBRICANT

[76] Inventor: Said Lounis, 4578 Kirchaldy, Bloomfield Hills, Mich. 48013

[21] Appl. No.: 102,416

[22] Filed: Sep. 29, 1987

[51] Int. Cl.[4] ..... F25B 43/02

[52] U.S. Cl. ..... 62/84; 62/149; 62/174; 62/292; 62/468

[58] Field of Search ..... 62/84, 149, 174, 292, 62/468

[56] References Cited

U.S. PATENT DOCUMENTS

| | | | |
|---|---|---|---|
| 3,232,070 | 2/1966 | Sparano | 62/292 |
| 3,238,737 | 3/1966 | Shrader et al. | 62/174 |
| 3,873,289 | 3/1975 | White | 62/292 |
| 3,974,659 | 8/1976 | Edwards | 62/84 |
| 4,441,330 | 4/1984 | Lower et al. | 62/149 |
| 4,476,688 | 11/1984 | Goddard | 62/292 |
| 4,646,527 | 3/1987 | Taylor | 62/292 |

*Primary Examiner*—Ronald C. Capossela
*Attorney, Agent, or Firm*—Daniel H. Bliss

[57] ABSTRACT

The present invention provides a method and apparatus for recovering and purifying a refrigerant containing lubricant from a refrigerant system. The apparatus includes an evacuation means for evacuating the refrigerant and lubricant from the refrigerant system. A reservoir means receives the evacuated refrigerant and lubricant. A means allows lubricant and refrigerant to exit the apparatus and enter the refrigerant system.

27 Claims, 1 Drawing Sheet

METHOD AND APPARATUS FOR RECOVERING, PURIFYING AND SEPARATING REFRIGERANT FROM ITS LUBRICANT

TECHNICAL FIELD

The present invention relates to a method and apparatus for recovering and purifying a refrigerant and, more particularly, a method and apparatus for recovering a refrigerant and separating lubricant from the refrigerant in an air conditioning or heat pump system.

BACKGROUND OF THE INVENTION

During the operation of an air conditioning or heat pump system, the refrigerant such as freon becomes contaminated by particulate and liquid lubricant such as oil, since oil is very miscible with freon, oil becomes entrained with the freon. After extended periods of time, the refrigerant becomes degraded and requires replacement. Typically, the refrigerant is bled from the system and discarded. As a result, new refrigerant and lubricant has to be added to the refrigerant system.

One attempt to solve this problem has been to devise a refrigerant recovery and purification system. An example of such a refrigerant recovery and purification system is disclosed in U.S. Pat. No. 4,646,527, issued Mar. 3, 1987, to Taylor. The Taylor patent discloses an apparatus having a pair of accumulators serially connected between the compressor and the refrigerant system being evacuated. The output of the compressor is connected to a heat exchanger position within each of the accumulators. The heat exchangers are connected to a condenser. The accumulators, having the heat exchangers positioned therein, function to distill the refrigerant flowing therethrough to separate the oil from the refrigerant. The oil is drained from the accumulators and discarded. Since the oil in the evacuated refrigerant has been removed, a separate oil separator filled with clean oil supplies oil to the compressor to prevent premature failure.

One problem or disadvantage with the above apparatus is that it takes a long time period to evacuate the refrigerant from the refrigerant system. Also, there is recontamination of the refrigerant from lubricant being supplied to the compressor before being stored. Further, it is impossible to calculate the amount of lubricant that needs to be added to the refrigerant system. Draining the refrigerant system of oil and replacing it can be time consuming and costly. Additionally, there is only one mode of operation of the apparatus for separating the lubricant from the refrigerant which limits the apparatus' flexibility.

Another problem arising in the refrigeration industry is that CFC refrigerants are destroying the ozone layer. Recently, several countries signed an international agreement to reduce consumption of CFC refrigerants by the year 2000. This will result in a scarcity of existing CFC refrigerants. Therefore, it will be necessary to reclaim as much of the existing CFC refrigerants as possible.

SUMMARY OF THE INVENTION

The present invention provides an apparatus for recovering and purifying refrigerant from a refrigerant system containing refrigerant mixed with a lubricant. The apparatus includes an evacuation means for evacuating the refrigerant and lubricant from the refrigerant system. A reservoir means receives the evacuated refrigerant and lubricant. A means allows lubricant and refrigerant to exit the apparatus and enter the refrigerant system.

The present invention also provides a method for recovering and purifying refrigerant containing lubricant from a refrigerant system. The method includes the steps of evacuating the refrigerant and lubricant from the refrigerant system with an evacuation means. The steps include receiving and storing the evacuated refrigerant and lubricant within a reservoir means. The steps further include separating the refrigerant from the lubricant within the reservoir means and allowing refrigerant and lubricant to exit the apparatus and enter the refrigerant system.

Accordingly, the present invention provides a much faster time period for evacuation of the refrigerant from the refrigerant system due to the presence of a vacuum in the reservoir and for recovery of the refrigerant in its liquid state. Also, there is no refrigerant re-contamination by the compressor of the apparatus. Further, the present invention provides greater flexibility because there are four modes of operation for processing the refrigerant and lubricant. Additionally, the present invention determines the amount of refrigerant and lubricant evacuated from and entering into the refrigerant system and allows additional refrigerant and lubricant to be added to the refrigerant system resulting from any deficiency. This results in an inexpensive and time saving operation. Finally, the present invention allows recovery of freon in existing refrigerant systems and purifying of the freon for further use.

FIGURES IN THE DRAWING

Other advantages of the present invention will be readily appreciated as the same becomes better understood by reference to the following detailed description when considered in connection with the accompanying drawing wherein:

FIG. 1 is a schematic view of the present invention.

DESCRIPTION OF THE PREFERRED EMBODIMENT

Figure 1:
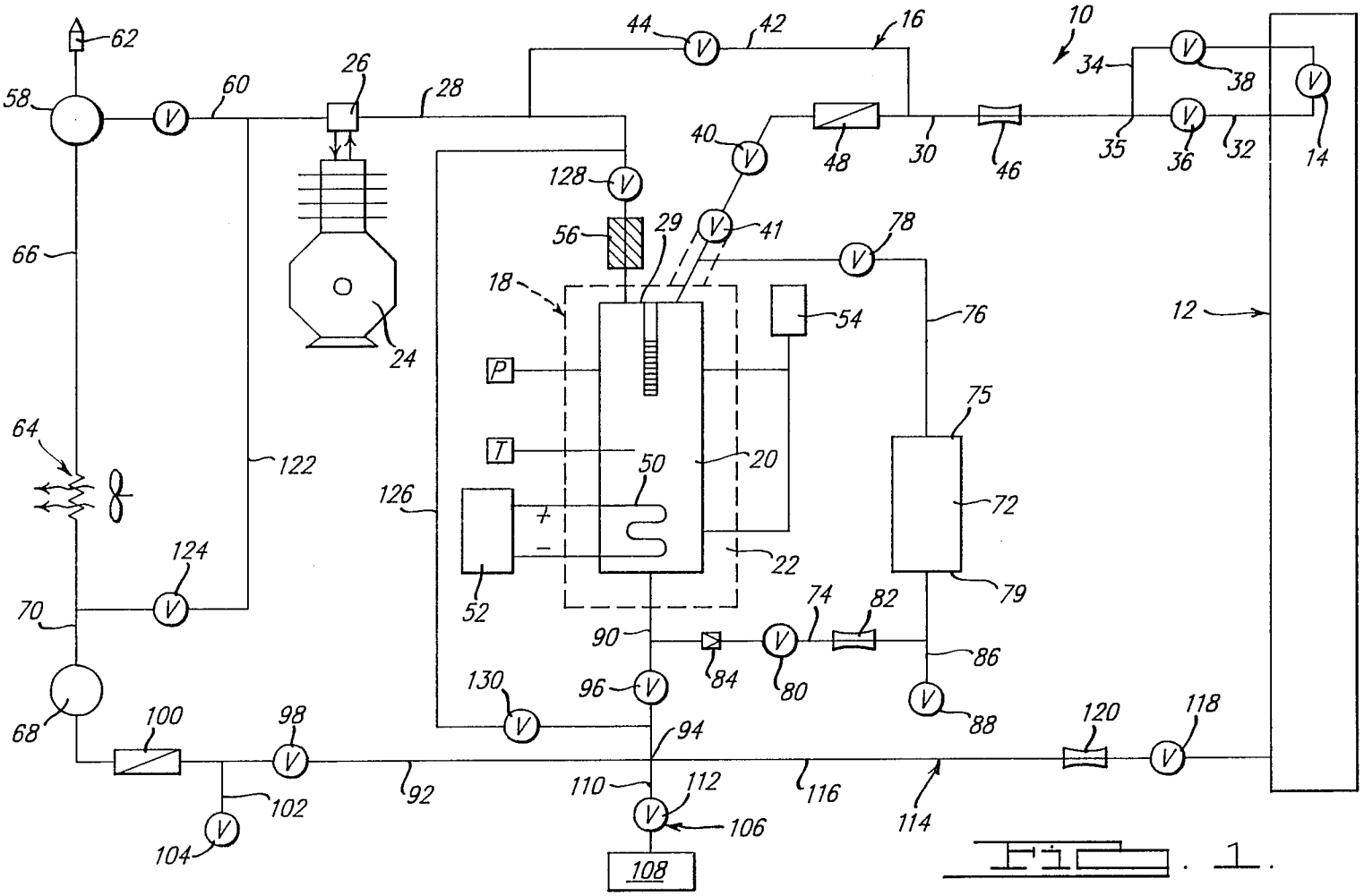

An apparatus for recovering and purifying refrigerant such as freon contaminated or mixed with a lubricant such as oil from a refrigerant system is generally shown at 10 in FIG. 1. The refrigerant system to be evacuated is generally indicated at 12, and may comprise an air conditioning or heat pump system. The refrigerant system 12 includes an expansion valve 14. The apparatus 10 of the present invention has an input removably connected to the refrigerant system 12 on each side of the expansion valve 14 and an output connected to the refrigerant system 12.

The apparatus 10 comprises an evacuation means, generally indicated at 16, for evacuating the refrigerant and lubricant from the refrigerant system 12, and a reservoir means, generally indicated at 18, for receiving and storing the evacuated refrigerant and lubricant. The apparatus 10 further comprises means for allowing lubricant and refrigerant to exit the apparatus 10 and enter the refrigerant system 12.

As illustrated in FIG. 1, the reservoir means 18 comprises a reservoir or tank 20 having and insulation material 22 disposed about the tank 20 to keep the heat flow or exchange from the surrounding environment to a minimum. The evacuation means 16 includes a compressor means comprising a compressor 24 for pulling a vacuum in the tank 20. The compressor 24 may be a Sultzer TM -type non-lubricated piston compressor. When the refrigeration system 12 is idle or between two cycles, the compressor 24 operates and pulls a very low vacuum in the tank 20 (28–29 in. Mercury). This vacuum will be used as a reserve when the method of the apparatus 10 is started. The compressor means includes a four-way reversing valve 26 connected to the compressor 24. The four-way reversing valve 26 allows the compressor 24 to function as a suction unit and as a pump.

The evacuation means 16 further comprises a conduit 28 interconnecting the four-way valve 26 and the top of tank 20 and a conduit 30 connected to the top 29 of the tank 20 and removably connected to the refrigerant system 12. The second conduit 30 has one end 32 removably connected to the refrigerant system 12 on one side of the expansion valve 14 and may include and additional conduit 34 connected at 35 to the second conduit 30 and removably connected to the refrigerant system 12 on the other side of the expansion valve 14. In other words, conduit 34 and the end 32 of conduit 30 form a "U" shape and are removably connected on each side of the expansion valve 14 of the refrigerant system 12.

The evacuation means 16 further comprises a valve 36 connected to end 32 of conduit 30 and a valve 38 connected to the conduit 34. The valves 36, 38 open to allow the refrigerant and lubricant to flow from the refrigerant system 12 and into the conduit 30 and may be closed to prevent flow of refrigerant and lubricant into the conduit 30 and to allow removal of the apparatus 10 from the refrigerant system 12. The evacuation means 16 further comprises a valve 40 connected to the conduit 30 near the tank 20 and an expansion valve 41 connected to the conduit 30 between the valve 40 and tank 20. The valve 40 opens the flow path in conduit 30 between the tank 20 and the refrigerant system 12 to allow refrigerant and lubricant to enter the tank 20. The valve 40 also closes the flow path in conduit 30 and prevents refrigerant and lubricant from escaping back through the conduit 30 once the apparatus 10 has been disconnected from the refrigerant system 12 and also, to allow the compressor 24 to pump the remaining refrigerant gas contained in refrigerant system 12 to be evacuated through conduit 42, by opening valve 44.

The evacuation means 16 also includes bypass means for bypassing or isolating the refrigerant in the tank 20 to allow the refrigerant remaining in the refrigerant system 12 to be reclaimed. The bypass means comprises a conduit 42 having one end attached to the conduit 30 and the other end connected to the conduit 28, thereby bypassing the tank 20. The bypass means further comprises a valve 44 connected to the conduit 42 for opening and closing the flow path between the first conduit 30 and conduit 28. By opening valve 40, gaseous refrigerant remaining in the refrigerant system 12 is allowed to flow from the refrigerant system 12 in the first conduit 30, through the third conduit 42 and to the first conduit 28, while bypassing the tank 20.

The apparatus 10 includes a flow meter means 46 connected to the conduit 30 and interconnecting the tank 20 and refrigerant system 12 for determining or measuring the amount of refrigerant evacuated from the refrigerant system 12. More specifically, the flow meter means 46 comprises a conventional flow meter 46 connected to the conduit 30 before the conduit 42 and the connection 35 of conduits 34 and 30 for measuring or determining the amount of liquid refrigerant that has flowed from the refrigerant system 12 and into the apparatus 10.

The apparatus 10 also includes a filter/dryer means 48 interconnecting valve 40 and flow meter 46 for cleaning or filtering and removing moisture from the refrigerant evacuated from the refrigerant system 12. The liquid refrigerant then goes through an expansion process through expansion valve 41. Some of the liquid refrigerant will vaporize or form a gaseous state, thus absorbing heat. Since the tank 20 is well insulated by the insulation material 22, heat flow or exchange will be minimal. Therefore, the vaporization of part of the refrigerant will lower the temperature of the remaining liquid refrigerant in the tank 20, causing the liquid refrigerant in tank 20 to remain in its liquid state.

Once the refrigerant and lubricant has been evacuated from the refrigerant system 12, it is temporarily stored in the tank 20. The apparatus 10 includes heater means 50 for supplying heat to the reservoir means 20 to heat and vaporize the refrigerant from a liquid state to a gaseous state in the tank 20. This causes the refrigerant to separate from the lubricant. The heater means 50 comprises a conventional resistant heater disposed within the tank 20 and connected to a source of electrical power 52. A control unit 54 controls or turns on and off the heater 50 to maintain the liquid refrigerant at a constant temperature. This temperature corresponds to the pressure in the tank 20. The control unit 54 is a high level safety cut-out for the compressor 24.

After the refrigerant system 12 has been evacuated, the tank 20 contains gaseous and liquid refrigerant and lubricant. The tank 20 may also contain a small amount of air present initially in the apparatus 10. The apparatus 10 includes a separator means 56 for allowing only gaseous air or refrigerant to exit the tank 20 and flow to the compressor 24. The separator means 56 comprises a conventional liquid/gas separator connected to conduit 28 between the tank 20 and four-way reversing valve 26 to allow only gaseous air or refrigerant to flow to the compressor 24.

The apparatus 10 includes collector means 58 comprising a tank or the like connected by a conduit 60 to the four-way reversing valve 26. A valve 61 is connected to conduit 60 to open and close the flow path between valve 26 and collector means 58. The gaseous air and refrigerant is contained or collected in the collector means 58. A purge means 62 is connected to the collector means 58 for allowing air to be automatically purged from the refrigerant.

The apparatus 10 also includes a condenser means, generally indicated at 64, connected by a conduit 66 to the collector means 58 for condensing the refrigerant from a gaseous state to a liquid state. A conventional condenser 64 commonly found in the art may be used. The apparatus 10 includes a refrigerant receiver means 68 comprising a tank or the like connected by a conduit 70 to the condenser means 64 for receiving the liquid refrigerant from the condenser means 64 and storing the liquid refrigerant therein.

The apparatus 10 further includes a lubricant receiver means 72 comprising a tank or the like connected to the tank 20 by conduits 74 and 76 for receiving lubricant and storing the lubricant therein. A valve 78 is connected to the conduit 76 for opening and closing the flow path between the top 29 of the tank 20 and the top 75 of the lubricant receiver means 72. A valve 80 is connected to the conduit 74 for opening and closing the flow path between the bottom 77 of the tank 20 and the bottom 79 of the lubricant receiver means 72. The valve 78 may be opened to allow the compressor 24 to pull a vacuum in the lubricant receiver means 72. The valve 78 may be shut once a vacuum is present in the lubricant receiver means 72. Once a vacuum is present in the lubricant receiver means 72, the valve 80 may be opened to allow lubricant to flow or rush through the conduit 74 and into the lubricant receiver means 72 after all the reclaimed refrigerant has been stored in refrigerant receiver 68, and the tank 20 has been pressurized by opening valves 26 and 128. A flow meter means 82 is connected to the conduit 74 between the valve 80 and the lubricant receiver means 72 for measuring or determining the amount of lubricant evacuated from the refrigerant system 12 or present in the lubricant receiver means 72. A check valve 84 is connected to the conduit 74 between the tank 20 and valve 80 to allow only one-way flow of the lubricant from the tank 20 to the lubricant receiver means 72 through conduit 74. Once the lubricant is emptied from the tank 20 and present in the lubricant receiver means 72, valve 80 is closed. A conduit 86 and valve 88 is connected to the conduit 74 or lubricant receiver means 72 to allow the lubricant in the lubricant receiver means 72 to be drained or dumped from the apparatus 10.

The apparatus 10 includes a conduit 90 extending either from the bottom 77 of the tank 20 or is connected to the conduit 74. A conduit 92 has one end connected to the refrigerant receiver means 68 and the other end connected to the conduit 90 at connection or juncture 94. A valve 96 is connected to conduit 90 for opening the flow path between the juncture 94 and the tank 20. A valve 98 is connected to the conduit 92 for opening and closing the flow path between the refrigerant receiver means 68 and juncture 94. Once the compressor 24 draws or pulls a vacuum in the tank 20, valves 96 and 98 may be opened to allow the liquid refrigerant stored in the refrigerant receiver system means 69 to flow from the refrigerant receiver means 68 to the tank 20 due to the presence of the vacuum in the tank 20. The apparatus 10 includes a filter/dryer 100 connected to the conduit 92 between the refrigerant receiver means 68 and valve 98 for allowing further purification of refrigerant from the refrigerant receiver means 68 to the tank 20. A conduit 102 has one end connected to the conduit 98 between the filter/dryer 100 and valve 98 and the other end connected to a valve 104. The valve 104 may be opened to allow the liquid refrigerant stored in the liquid refrigerant receiver means 68 to be drained or dumped from the apparatus 10.

The apparatus 10 also includes means, generally indicated at 106, for allowing either refrigerant or lubricant from a supply source 108 to enter the tank 20. More specifically, the means 106 comprises a conduit 110 having one end connected to the supply source 108 and the other end connected at juncture 94 to the conduit 90. A valve 112 is connected to the conduit 110 between the juncture 94 and supply source 108. Valve 112 may be opened to allow refrigerant or lubricant to be injected into or flow from the supply source 108 and through conduit 116 to the refrigerant system 12.

The apparatus 10 further includes means, generally indicated at 114, for allowing refrigerant in the reservoir means 18 or the receiver 68 to exit the reservoir means 18 or receiver 68 and enter the refrigerant system 12. The means 114 comprises a conduit 116 having one end removably connected at juncture 94 to conduit 90 and the other end connected to the refrigerant system 12. A valve 118 is connected to the conduit 116. Valves 96 or 98 or 118 may be opened to allow refrigerant within the tank 20 or the receiver 68 to flow from the tank 20 or the receiver 68 through conduits 90 or 92 and 116 to the refrigerant system 12. This occurs because the four-way reversing valve 26 is reversed and the compressor acts as a pump to push the refrigerant within the tank 20 or the receiver 68 back into the refrigerant system 12. The apparatus 10 includes a flow meter means 120 connected to the conduit 116 between the juncture 94 and refrigerant system 12 for measuring or determining the amount of refrigerant entering the refrigerant system 12 and for determining if any refrigerant is required to be added to the refrigerant system 12.

The apparatus 10 includes a conduit 122 interconnecting conduits 60 and 70. A valve 124 is connected to the conduit 122 to open and close the flow path between the four-way reversing valve 26 and refrigerant receiver means 68 while bypassing the collector means 58 and condenser means 64 to avoid sucking air or other incondensibles that may be present in the collector means 58 when valve 26 is reversed. Another conduit 126 interconnects conduits 28 and 90. A valve 128 is connected to conduit 28 between conduit 126 and separator means 56. A valve 130 is connected to conduit 126 to open and close the flow path between conduit 28 and conduit 90 to allow the compressor 24 to pull a vacuum in the conduit 114.

IN OPERATION

As illustrated in FIG. 1, the apparatus 10 is connected to the refrigerant system 12 on each side of the expansion valve 14 of the refrigerant system 12. The compressor 24 has previously operated to maintain a vacuum within the tank 20. First, the refrigerant system 12 containing refrigerant and lubricant is evacuated. Since a vacuum exists in the tank 20, valves 36, 38 and 40 are opened to allow liquid refrigerant contained in the refrigerant system 12 to flow through conduits 34 and 30 and rush into the tank 20. The amount of liquid refrigerant is measured by flow meter means 46 and is cleaned by filter/dryer means 48. The liquid refrigerant then passes through an expansion valve 41, causing some of the liquid refrigerant to vaporize or form a gaseous state by absorbing heat. Since the tank 20 is insulated by the insulation material 22, heat flow from the surroundings or environment will be minimal. Therefore, vaporization of the refrigerant will lower the temperature of the liquid refrigerant in the tank 20.

As soon as the liquid refrigerant starts vaporizing, the pressure in the tank 20 will increase. When a predetermined pressure setting is reached, the compressor 24 will start operation and maintain a constant low pressure or vacuum in the tank 20. The liquid refrigerant will flow from the refrigerant system 12 to the tank 20. When all of the liquid refrigerant in the refrigerant system 12 has been transferred to the apparatus 10 by using the flow meter means 46 as a guideline, valve 40 will be closed to contain the liquid refrigerant within the tank 20. The valve 44 will then be opened, and the tank 20, containing the reclaimed liquid refrigerant, is then isolated from the refrigerant system 12. The compressor 24 will continue pulling a vacuum from the refrigerant system 12 to reclaim the remaining gaseous refrigerant and any other incondensibles that may be present, from the refrigerant system 12 which flows to the collector means 58. When an acceptable vacuum is reached, meeting either the operator's or EPA's specification, valves 38, 36 and 44 will be closed and the apparatus 10 may be disconnected from the refrigerant system 12.

Once the refrigerant and lubricant has been evacuated from the refrigerant system 12, it is temporarily stored in the tank 20. The heater means 50 supplies heat to the tank 20 to heat and vaporize the refrigerant from a liquid state to a gaseous state. This causes the refrigerant to separate from the lubricant. The gaseous refrigerant passes through the separator means 56 and conduits 28, 60 to the collector means 58. The gaseous refrigerant flows from the collector means 58 through conduit 66 to the condenser means 64 where the gaseous refrigerant is condensed to a liquid state. The condensed refrigerant then flows from the condenser means 64 through conduit 70 where it is temporarily stored in the refrigerant receiver means 68. At this point, liquid refrigerant is stored in the receiver means 68 and only lubricant remains at the bottom of the tank 20.

The refrigerant and lubricant may be processed at least four different ways. As to the first method, it may be desired to put the refrigerant and lubricant contained in tank 20 back into the refrigerant system 12 once the refrigerant system 12 has been repaired, for example, because it is new or fresh. Liquid refrigerant from refrigerant system 12 condensed and stored in receiver 68 is first fed back into tank 20 by opening valves 98 and 96, before starting the cycle. The method is accomplished by reversing the four-way valve 26 and resetting the compressor 24 to act as a pump. Valves 96 and 118 are opened and the compressor 24 pumps the refrigerant and lubricant contained in tank 20 back into the refrigerant system 12 through conduits 90 and 116. The flow meter 20 may be used to determine if any refrigerant makeup or additional refrigerant is required to be added to the refrigerant system 12. If any refrigerant or lubricant is required to be added to the refrigerant system 12, valve 112 is opened and valve 96 is closed to allow either metered refrigerant or metered lubricant from a supply source 108 to flow through conduits 110 and 116 to refrigerant system 12.

As to the second method, the compressor 24 keeps operating or running until all the refrigerant is evaporated from the tank 20 and stored in the refrigerant receiver means 32. At that point, only lubricant remains at the bottom of the tank 20. Valve 80 is closed and valve 78 is opened. The compressor 24 operates to draw or pull a vacuum in the tank 20 and a lubricant receiver means 72. Once a vacuum exists, valve 78 is closed and valve 80 is opened. The four-way valve 26 is reversed and the compressor pressurizes the tank 20 and pushes the lubricant through the flow meter means 82 into the lubricant receiver means 72. Valve 80 is closed once all the lubricant is removed from the tank 20 and stored in a lubricant receiver means 72. The lubricant may be dumped or drained from the lubricant receiver means 72 by opening valve 88. The amount of lubricant to be added by be determined from the flow meter means 82. The lubricant is added as previously described.

It may be desirable to use the refrigerant stored in the refrigerant receiver means 68. Valves 98 and 96 are opened. The refrigerant stored in receiver 68 is transferred to tank 20 by means of a vacuum through conduits 92 and 90. Calculated make-up lubricant is fed directly to refrigerant system 12 and enters the refrigerant system 12 as previously described.

The third method is similar to the second method. When the refrigerant is evaporated from the tank 20 and stored in the refrigerant receiver means 68, a certain amount of oil is still entrained in the refrigerant due to the miscibility of lubricant in the refrigerant. As a result, a single evaporation does not ensure a pure refrigerant. Therefore, at the end of the evaporation or separation cycle, and after the lubricant has been measured and evacuated from the tank 20, the liquid contained in the refrigerant receiver means 68 can be transferred back into the tank 20 for another evaporation or separation process and the lubricant can be dumped again. This provides the advantage of allowing the operator as many purifying cycles as desired. However, the lubricant has to be dumped or evacuated from the tank 20 after every purifying cycle.

The fourth method is also similar to the second method. However, it may be desired to replace the refrigerant stored in the refrigerant receiver means 68. This is accomplished by opening valve 104 and closing valve 98 to allow the liquid refrigerant to flow from the refrigerant receiver means 68 through filter/dryer 100 and conduit 102. Refrigerant may then be added to the refrigerant system 12 as previously described.

Alternatively, the refrigerant system 12 may be drained of its lubricant completely by other means. Both lubricant and refrigerant are entirely replaced as previously described.

The present invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the present invention may be practiced otherwise than as specifically described.

What is claimed is:

1. An apparatus for recovering and purifying refrigerant from a refrigerant system, said apparatus comprising:

evacuation means for evacuating the refrigerant and lubricant from the refrigerant system;

reservoir means for receiving and storing the evacuated refrigerant and lubricant;

means for allowing lubricant and refrigerant to exit said apparatus and enter the refrigerant system;

said evacuation means including compressor means for maintaining a vacuum in said reservoir means;

said evacuation means comprising a first conduit interconnecting said compressor means and said reservoir means, a second conduit connected to said reservoir means and removably connected to the refrigerant system, and first valve means connected to said second conduit for opening and closing the flow path between said reservoir means and the refrigerant system; ;and a third conduit interconnecting said first and second conduits and second valve means connected to said third conduit for opening and closing to allow refrigerant to flow from said first and second conduits while bypassing said reservoir means.

2. An apparatus as set forth in claim 1 including heater means for supplying heat to said reservoir means to heat and vaporize the refrigerant from a liquid state to a gaseous state in said reservoir means.

3. An apparatus as set forth in claim 1 including separator means for allowing only gaseous refrigerant to exit said reservoir means and flow to said compressor means.

4. An apparatus as set forth in claim 1 including condenser means for condensing the refrigerant from a gaseous state to a liquid state.

5. An apparatus as set forth in claim 4 including refrigerant receiver means for receiving the liquid refrigerant from said condenser means and storing the liquid refrigerant therein.

6. An apparatus as set forth in claim 1 including bypass means for isolating the refrigerant in said reservoir means and for reclaiming the refrigerant remaining in the refrigerant system.

7. An apparatus as set forth in claim 1 including a lubricant receiver means connected to said reservoir means for receiving lubricant and storing the lubricant therein.

8. An apparatus as set forth in claim 7 including a flow meter means interconnecting said reservoir means and said lubricant receiver means for determining the amount of lubricant evacuated from the refrigerant system.

9. An apparatus as set forth in claim 1 further characterized by said reservoir means comprising a tank having insulation material disposed about said tank.

10. An apparatus as set forth in claim 1 further characterized by said compressor means comprising a compressor and a four-way reversing valve connected to said compressor.

11. An apparatus for recovering and purifying refrigerant from a refrigerant system, said apparatus comprising:

evacuation means for evacuating the refrigerant and lubricant from the refrigerant system;

reservoir means for receiving and storing the evacuated refrigerant and lubricant;

means for allowing lubricant and refrigerant to exit said apparatus and enter the refrigerant system;

said evacuation means including compressor means for maintaining a vacuum in said reservoir means;

heater means for supplying heat to said reservoir means to heat and vaporize the refrigerant from a liquid state to a gaseous state in said reservoir means;

separator means for allowing only gaseous refrigerant to exit said reservoir means and flow to said compressor means;

condenser means for condensing the refrigerant from a gaseous state to a liquid state;

refrigerant receiver means for receiving the liquid refrigerant from said condenser means and storing the liquid refrigerant therein;

bypass means for isolating the refrigerant in said reservoir means and for reclaiming the refrigerant remaining in the refrigerant system;

lubricant receiver means connected to said reservoir means for receiving lubricant and storing the lubricant therein;

flow meter means interconnecting said reservoir means and said lubricant receiver means for determining the amount of lubricant evacuated from the refrigerant system;

said reservoir means comprising a tank having insulation material disposed about said tank;

said compressor means comprising a compressor and a four-way reversing valve connected to said compressor; and said evacuation means comprising a first conduit interconnecting said compressor means and said reservoir means, a second conduit connected to said reservoir means and removably connected to the refrigerant system, and first valve means connected to said second conduit for opening and closing the flow path between said tank and the refrigerant system.

12. An apparatus as set forth in claim 11 characterized by said bypass means comprising a third conduit interconnecting said first and second conduits and second valve means connected to said third conduit for opening and closing to allow refrigerant to flow from said first and second conduits while bypassing said tank.

13. An apparatus as set forth in claim 12 including a fourth conduit connected to said tank and a third valve means connected to said fourth conduit for opening and closing to allow either of refrigerant and lubricant from a supply source to enter the refrigerant system.

14. An apparatus as set forth in claim 13 including valve means for opening and closing to allow liquid refrigerant to be dumped from said refrigerant receiver means.

15. An apparatus as set forth in claim 14 including collector means interconnecting said four-way valve and said receiver means for collecting the gaseous refrigerant.

16. An apparatus as set forth in claim 15 including purge means for allowing air to be purged from the refrigerant.

17. An apparatus as set forth in claim 16 including second flow meter means for determining the amount of refrigerant evacuated from the refrigerant system.

18. An apparatus as set forth in claim 17 including a filter/dryer means for filtering and removing moisture from the refrigerant evacuated from the refrigerant system.

19. An apparatus as set forth in claim 18 characterized by said means comprising a fifth conduit interconnecting said tank and the refrigerant system and valve means for opening and closing the flow path between said tank and the refrigerant system.

20. An apparatus as set forth in claim 19 including a third flow meter means connected to said fifth conduit for determining the amount of either of refrigerant and lubricant entering the refrigerant system.

21. An apparatus for recovering and purifying refrigerant containing lubricant from a refrigerant system, said apparatus comprising:

evacuation means for evacuating the refrigerant and lubricant from the refrigerant system;

reservoir means for receiving and storing the evacuated refrigerant and lubricant;

means for allowing the lubricant and refrigerant in said apparatus to exit said apparatus and enter the refrigerant system;

said evacuation means including compressor means for maintaining a vacuum in said reservoir means;

said evacuation means comprising a first conduit interconnecting said compressor means and said reservoir means, a second conduit connected to said reservoir means and removably connected to refrigerant system, first valve means connected to said second conduit for opening and closing the flow path between said reservoir means and the refrigerant system; and said reservoir means comprising a tank having insulation material disposed about said tank.

22. An apparatus as set forth in claim 21 including means for determining the amount of either of lubricant and refrigerant evacuated from the refrigerant system.

23. An apparatus for recovering and purifying refrigerant containing lubricant from a refrigerant system, said apparatus comprising:

evacuation means for evacuating the refrigerant and lubricant from a refrigerant system;

reservoir means for receiving and storing the evacuated refrigerant and lubricant;

heater means for supplying heat to said reservoir means for separating the refrigerant from the lubricant;

means for allowing lubricant and refrigerant to exit said apparatus and enter the refrigeration system;

said evacuation means including compressor means for maintaining a vacuum in said reservoir means;

said evacuation means comprising a first conduit interconnecting said compressor means and said reservoir means, a second conduit connected to said reservoir means and removably connected to refrigerant system, first valve means connected to said second conduit for opening and closing the flow path between said reservoir means and the refrigerant system; and said reservoir means comprising a tank having insulation material disposed about said tank.

24. An apparatus for recovering and purifying refrigerant containing lubricant from a refrigerant system, said apparatus comprising:

evacuation means for evacuating the refrigerant and lubricant from the refrigerant system;

reservoir means for receiving and storing the evacuated refrigerant and lubricant;

means for separating the refrigerant from the lubricant;

means for allowing refrigerant and lubricant to exit said apparatus and enter the refrigerant system;

evacuation means including compressor means for maintaining a vacuum in said reservoir means;

said separating means comprising heater means for supplying heat to said reservoir means to heat and vaporize the refrigerant from a liquid state to a gaseous state in said reservoir means;

separator means for allowing only gaseous refrigerant vapor to exit said reservoir means and flow to said compressor means;

condenser means for condensing the refrigerant from a gaseous state to a liquid state;

refrigerant receiver means for receiving the liquid refrigerant from said condenser means and storing the liquid refrigerant therein;

bypass means for isolating the refrigerant in said reservoir means and for reclaiming the refrigerant remaining in the refrigerant system;

lubricant receiver means connected to said reservoir means for receiving lubricant and storing the lubricant therein;

flow meter means interconnecting said reservoir means and said lubricant receiver means for determining the amount of lubricant evacuated from the refrigerant system;

said reservoir means comprising a tank having insulation material disposed about said tank;

said compressor means comprising a compressor and a four-way reversing valve connected to said compressor;

said evacuation means comprising a first conduit interconnecting said compressor means and said reservoir means, a second conduit connected to said reservoir means and removably connected to the refrigerant system, and first valve means connected to said second conduit for opening and closing the flow path between said tank and the refrigerant system;

said separator means comprising a liquid/vapor separator connected to said first conduit between said four-way valve and said tank;

said heater means comprising a resistance heater disposed within said tank and connected to a source of electrical power;

said bypass means comprising a third conduit interconnecting said first and second conduits and second valve means connected to said third conduit for opening and closing to allow refrigerant to flow from said first and second conduits while bypassing said tank;

a fourth conduit connected to said tank and a third valve means connected to said fourth conduit for opening and closing to allow either of refrigerant and lubricant from a supply source to enter said tank;

a second flow meter means connected to said fifth conduit for determining the amount of refrigerant entering the refrigerant system;

a sixth conduit interconnecting said tank and said refrigerant receiver means and a fourth valve means for opening and closing the flow path between said receiver means and said tank;

a seventh conduit connected to said sixth conduit and fifth valve means connected to said seventh conduit for opening and closing to allow liquid refrigerant to be dumped from said refrigerant receiver means;

collector means interconnecting said four-way valve and said receiver means for collecting the gaseous refrigerant;

purge means for allowing air to be purged from the refrigerant;

an eighth conduit interconnecting said collector means and said four-way valve;

sixth valve means connected to said eighth conduit to allow gaseous refrigerant to flow between said collector and said four-way valve;

a ninth conduit interconnecting said four-way valve and said separator means and said bottom of said tank;

seventh valve means connected to said ninth conduit for opening and closing to allow refrigerant to flow between said four-way valve and said separator means and the bottom of said tank;

eighth valve means interconnecting said four-way valve and said separator means to allow refrigerant to flow between said separator means and said four-way valve;

a tenth conduit interconnecting said lubricant receiver means and said first conduit;

ninth valve means connected to said tenth conduit for opening and closing the flow path between said first conduit and said lubricant receiver means;

an eleventh conduit interconnecting said lubricant receiver means and the bottom of said tank;

tenth valve means for opening and closing the flow path between said tank and said lubricant receiver means;

third flow meter means for determining the amount of refrigerant evacuated from the refrigerant system;

filter/dryer means for filtering and removing moisture from the refrigerant evacuated from the refrigerant system;

a twelfth conduit interconnecting said four-way valve and said refrigerant receiver means to bypass said condenser means;

eleventh valve means for opening and closing the flow path between said refrigerant receiver means and said four-way valve; and a thirteenth conduit interconnecting said collector and said condenser means to allow refrigerant to flow between said collector and said condenser means.

25. An apparatus for recovering and purifying refrigerant from a refrigerant system, said apparatus comprising:

evacuation means for evacuating the refrigerant and lubricant from the refrigerant system;

reservoir means for receiving and storing the evacuated refrigerant and lubricant;

means for allowing lubricant and refrigerant to exit said apparatus and enter the refrigerant system;

said evacuation means including compressor means for maintaining a vacuum in said reservoir means;

said evacuation means comprising a first conduit interconnecting said compressor means and said reservoir means, a second conduit connected to said reservoir means and removably connected to the refrigerant system, and first valve means connected to said second conduit for opening and closing the flow path between said reservoir means and the refrigerant system; and heater means for supplying heat to said reservoir means to heat and vaporize the refrigerant from a liquid state to a gaseous sate in said reservoir means.

26. An apparatus for recovering and purifying refrigerant from a refrigerant system, said apparatus comprising:

evacuation means for evacuating the refrigerant and lubricant from the refrigerant system;

reservoir means for receiving and storing the evacuated refrigerant and lubricant;

means for allowing lubricant and refrigerant to exit said apparatus and enter the refrigerant system;

said evacuation means including compressor means for maintaining a vacuum in said reservoir means;

said evacuation means comprising a first conduit interconnecting said compressor means and said reservoir means, a second conduit connected to said reservoir means and removably connected to the refrigerant system, and first valve means connected to said second conduit for opening and closing the flow path between said reservoir means and the refrigerant system; and bypass means for isolating the refrigerant in said reservoir means and for reclaiming the refrigerant remaining in the refrigerant system.

27. An apparatus for recovering and purifying refrigerant from a refrigerant system, said apparatus comprising:

evacuation means for evacuating the refrigerant and lubricant from the refrigerant system;

reservoir means for receiving and storing the evacuated refrigerant and lubricant;

means for allowing lubricant and refrigerant to exit said apparatus and enter the refrigerant system;

said evacuation means including compressor means for maintaining a vacuum in said refrigerant means;

said evacuation means comprising a first conduit interconnecting said compressor means and said reservoir means, a second conduit connected to said reservoir means and removably connected to the refrigerant system, and first valve means connected to said second conduit for opening and closing the flow path between said reservoir means and the refrigerant system;

bypass means for isolating the refrigerant in said reservoir means and for reclaiming the refrigerant remaining in the refrigerant system;

said reservoir means comprising a tank having insulation material disposed about said tank; and heater means for supplying heat to said reservoir means to heat and vaporize the refrigerant from a liquid state to a gaseous state in said reservoir means.

* * * * *